United States Patent [19]

Krasuski et al.

[11] Patent Number: 4,924,652

[45] Date of Patent: May 15, 1990

[54] INTEGRATED OFFICE MACHINE FOR FOLDING MAIL AND INSERTING IT INTO ENVELOPES

[75] Inventors: Marek Krasuski, Fontenay Aux Roses; Bernard Prugnolle, Pantin, both of France

[73] Assignee: Societe Anonyme dite: Alcatel Satmam, Bagneux, France

[21] Appl. No.: 380,341

[22] Filed: Jul. 17, 1989

[30] Foreign Application Priority Data

Jul. 27, 1988 [FR] France ..... 88 10118

[51] Int. Cl.[5] ..... B65B 5/04; B65B 59/04

[52] U.S. Cl. ..... 53/55; 53/117; 53/266 A; 53/569

[58] Field of Search ..... 53/64, 69, 55, 569, 53/266 A, 117, 116, 381 R, 382, 387, 206, 460

[56] References Cited

U.S. PATENT DOCUMENTS 2,728,178 12/1955 Kern ..... 53/266 A X
2,766,569 10/1956 Strother et al. ..... 53/266 A X
2,915,863 12/1959 Kummer ..... 53/266 A X
3,319,395 5/1967 Lundquist et al. ..... 53/266 A X
4,619,101 10/1986 Harvey, Jr. et al. ..... 53/117

FOREIGN PATENT DOCUMENTS 1237873 6/1971 United Kingdom .

*Primary Examiner*—James F. Coan
*Attorney, Agent, or Firm*—Sughrue, Mion, Zinn, Macpeak & Seas

[57] ABSTRACT

The machine comprises a quasi-closed frame constituted by a top frame (5A) hinged to a bottom frame )5B), a first path (10) for mail and a second path (20) for empty envelopes running through the top frame (5A), a third path 30) for filled envelopes running between the top and bottom frames, a folding module (11) and a filling module (31) each having one portion of their paths in the top frame and the remaining portion in the bottom frame and directly coupling the first path and the second path to the filling module on the third path. The machine is applicable to processing mail.

21 Claims, 2 Drawing Sheets

INTEGRATED OFFICE MACHINE FOR FOLDING MAIL AND INSERTING IT INTO ENVELOPES

The present invention relates to an office machine for putting mail into envelopes, as and when the items of mail are prepared.

BACKGROUND OF THE INVENTION

Numerous machines already exist for processing mail automatically. These include collators and folders or collator/folders for processing documents such as previously prepared items of mail to be put into envelopes, inserters for filling envelopes with the folded documents, and envelope closing machines for moistening and then folding down the gummed flap of each filled envelope against the envelope body. At least some of these machines are coupled together and housed in a common installation for automatically processing mail.

Installations for automatically processing mail are complex and bulky. They are required to operate reliably at high throughputs. They include internal paths for documents, for initially empty envelopes, and for filled envelopes to be closed, which paths meet in an inserter which contains a portion of each of them. These paths are long, with complicated trajectories in order to facilitate the performance of the operations that are to be performed on each of them.

Gaining access to these paths for the purpose of clearing jams which may happen is difficult and may require a considerable length of time. Synchronizing the operations to be performed on these paths requires complex and expensive control equipment which contributes significantly to the considerable bulk of such installations.

Such installations are therefore completely unsuitable as office equipment which is to perform comparable operations while being above all compact and as easy and practical to use as any other office equipment for use by secretaries.

The object of the present invention is to provide an integrated office machine for folding documents and filling envelopes which puts mail into envelopes as and when the mail is made available.

SUMMARY OF THE INVENTION

The present invention provides an integrated office machine for folding items of mail and putting them into envelopes, the machine comprising a first path coupled to a mail inlet and feeding a folder having two folding pockets associated with a set of folding rollers, a second path coupled to an empty envelope inlet and feeding a filling station itself coupled to the folder to receive folded mail, and a third path fitted with means for closing the envelopes and coupled to the filling station and to an outlet for filled and closed envelopes, wherein the machine is mounted in a quasi-closed machine frame constituted by a top frame hinged to a bottom frame to open about a hinge axis at the rear end of the bottom frame, and:

said first and second paths are defined inside the top frame, and said third path is defined between said top and bottom frames, with said second path leading to said third path;

said filling station constitutes a functional filling module on said third path and at the opposite end to the envelope inlet on the second path, a portion of said functional module being mounted in the top frame and the remainder being mounted in the bottom frame; and said folder constitutes a folding functional module between said first and third paths, with a portion of the set of folding rollers and one of the folding pockets being mounted in the top frame and with the remaining portion of the set of folding rollers and the other folding pocket being mounted in the bottom frame, the folding module having an inlet at the opposite end to the mail inlet on the first path and an outlet facing said filling module to which it is directly coupled.

Advantageously, the first and second paths are defined inside the top frame in which they intersect, the top frame having the mail inlet and the envelope inlet in the top thereof, with the mail inlet being closer to the front than the envelope inlet.

The machine may include a reversible motor for driving the envelopes along said second and third paths, and coupled to a control circuit for stopping the envelope in a defined filling position in the filling module for filling purposes on the basis of the position of each envelope being detected on said third path, with the filled envelope being advanced along the third path to a defined closure position and with the envelope then being reversed along said first path in order to be closed completely.

The closure means may include a pair of presser rollers pivotally mounted with respect to the third path and controlled to move between a rest position off the third path while the envelope is advancing along the third path, and a working position on the third path, in which the presser rollers lie on either side of the third path while the envelope is reversing along said third path.

BRIEF DESCRIPTION OF THE DRAWINGS

An embodiment of the invention is described by way of example with reference to the accompanying drawings, in which.

DETAILED DESCRIPTION

Figure 1:
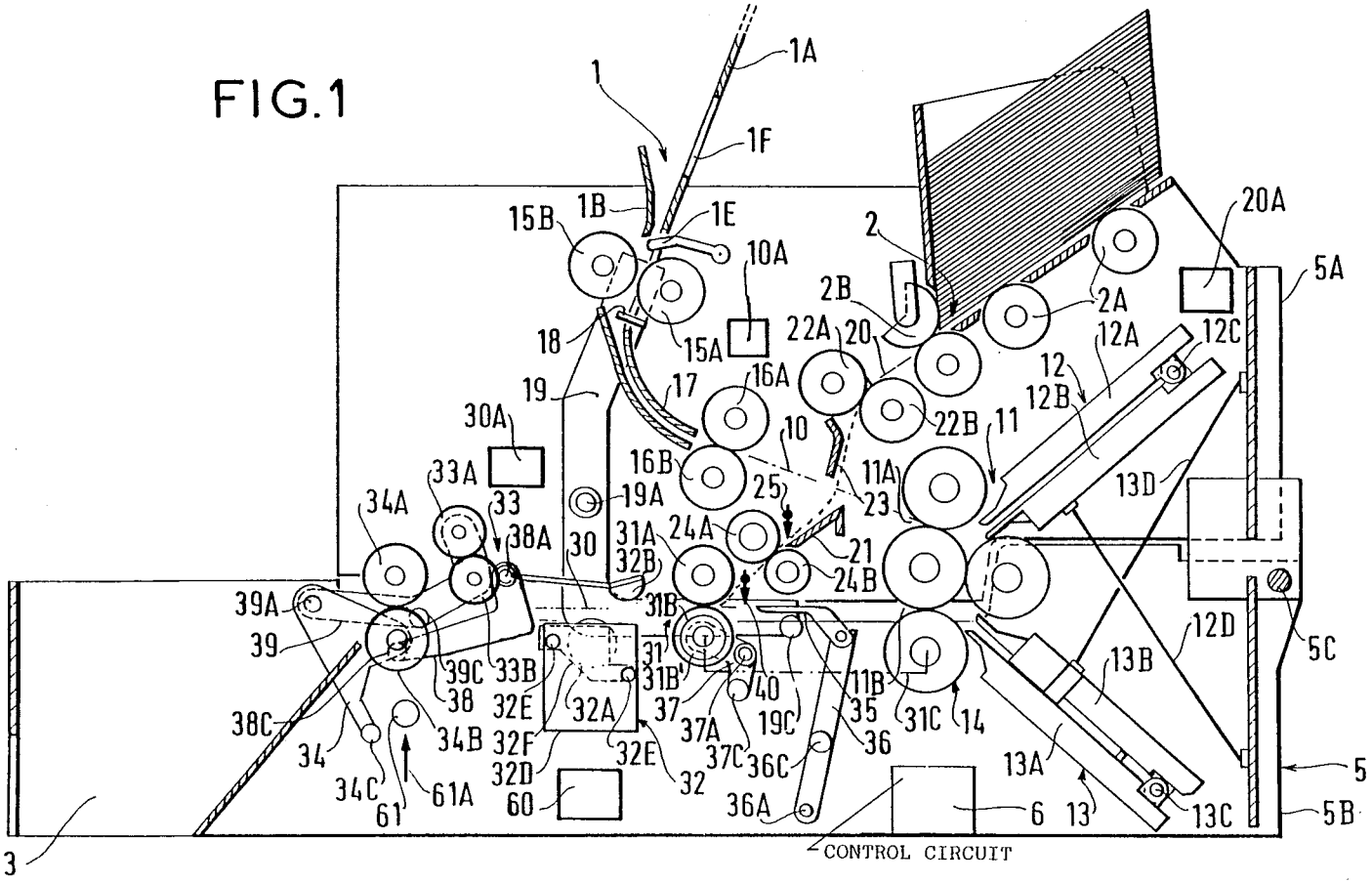
FIG. 1 is a diagram of a machine in accordance with the present invention.

The office machine shown in FIG. 1 is intended to put mail into envelopes, preferably as and when the mail is prepared. The machine forms a part of the equipment of a secretary's work station and it constitutes one of the machines available to the person working at the work station. Such a secretary's work station is not shown. The machine of the invention may merely be placed on a work surface of the station in a position to be easily accessible to the secretary, in particular for the purpose of inserting mail into the machine which then inserts the mail into an envelope.

The machine has a mail inlet 1, an empty envelope magazine 2, and an outlet 3 for envelopes which have been filled and closed, said inlets and outlets being formed on a frame 5 of the machine. The frame 5 comprises two parts, namely a top frame 5A and a bottom frame 5B. The bottom face of the top frame is open and is hinged on the open top face of the bottom frame 5B about an axis 5C. The axis 5C is carried by the bottom frame and is close to its rear wall, assuming the machine to be installed in a secretary's work station. The top frame 5A is also latched to the bottom frame 5B, thereby closing it, by conventional releasable latching means (not shown).

The mail inlet 1 and the empty envelope magazine 2 are defined in the top wall of the top frame 5A, with the inlet 1 being closer to the front of the machine than the empty envelope magazine 2. The outlet 3 for filled and closed envelopes is defined at the bottom and at the front of the bottom frame 5B. Items of mail that have been prepared are thus easily inserted via the inlet 1, and closed envelopes are just as easily taken from the outlet 3. Bunches of empty envelopes are placed in the magazine 2 which constitute the empty envelope inlet, thereby avoiding the need manually to insert each empty envelope one-by-one into the empty envelope inlet.

The mail inlet 1 leads to a mail path 10 through the machine and feeding a folding functional module 11. The folding module 11 has two folding pockets 12 and 13 associated with a set of folding rollers 14. The path 10 defines the trajectory followed by mail going from the inlet 1 to the folding module 11. It includes a bend deflecting mail from the inlet 1 towards the rear of the top frame 5A in order to feed the folding module which is mounted in part in the rear portion of the frame 5A with the remainder thereof being mounted in the rear portion of the frame 5B. At the end of the path 10, the folding module doubles back the trajectory of the mail which it is folding.

The empty envelope magazine 2 constituting the empty envelope inlet leads to an empty envelope path 20 through the machine. The path 20 intercepts the mail path 10 and terminates substantially in the middle of the machine. It follows a substantially S-shaped path and is fitted with means 21 for opening the flaps of empty envelopes.

The closed enveloped outlet 3 opens out from a filled envelope path 30. This path is substantially linear and runs above the outlet 3 between the top and bottom frames 5A and 5B from the empty envelope path 20 to the front of the machine, and it is substantially in alignment with the mail outlet from the folding module 11. The path 30 is fitted with a filling functional module 31 for putting mail into empty envelopes, with a flap-moistening functional module 32, and with a module 33 for folding and closing flaps.

The modules 11, 31, and 32 for folding, filling, and moistening are said to be "functional" since they come apart when the top frame 5A is opened away from the bottom frame 5B.

A control circuit 6 defines control signals applies to the machine during a control cycle.

The various components of the machine are described in greater detail below.

The mail inlet 1 on the machine is fitted with a flap which extends above the top frame 5A sloping slightly backwards relative to the vertical. The flap comprises an inlet tray 1A against which each item of mail to be put into an envelope is placed flat. The bottom of the inlet tray 1A extends a short distance into the top frame 5A through the top wall of the frame 5A which holds the flap in position. A small counterplate 1B projects slightly from either side of the top wall of the frame 5A and is associated with the inlet tray and is mounted facing its foot. Together with the inlet tray, it defines a short inlet chute passing through the top wall of the frame 5A. This inlet chute carries the reference 1 of the mail inlet.

This inlet chute 1 flares outside the frame to facilitate insertion of mail otherwise supported by the inlet tray 1A. Inside the frame, the chute is coupled to the path 10 and is fitted to constitute a controlled access to the mail path 10.

The inlet tray 1A advantageously has side rims (not shown), at least over a portion of its height. Also, immediately above the top wall of the top frame 5A, it has side windows referenced 1F. These windows 1F are used, prior to putting a multi-sheet item of mail into an envelope, e.g. a check and its accompanying letter, with the letter being placed in front of the check and overlying it, for allowing an operator in front of the machine to adjust the position of the check behind the letter by hand, should that be necessary.

The inlet tray 1A is advantageously made of molded transparent plastic material. The level to which the empty envelope magazine 2 is filled can be observed from in front of the machine by looking through the tray.

The mail path 10 is defined by two sets of drive wheels 15A and 16A together with two associated sets of backing wheels 15B and 16B, and also by an intermediate guide chute 17 which is curved and constituted by a pair of deflectors. It may also include a coupling chute (not shown) disposed between the wheels and backing wheels 16A, 16B and the folding module. The coupling chute is substantially linear and is interrupted by the empty envelope path 20 which intersects the mail path 10 at the coupling chute. Alternatively the coupling chute may extend on one side only of the path 20. The wheels and backing wheels 15A & 15B and 16A & 16B, and the chute 17 are mounted in the top frame 5A.

The pair of sets of wheels and backing wheels 15A and 15B is mounted in association with a set of shutter fingers 18 on the end portion of the chute 1 inside the frame 5A in order to control access to the mail path 10.

The set of wheels 15A is mounted on one side of the chute 1 and it passes through the bottom of the inlet tray a little way inside the chute 1. The set of backing wheels 15B is pivotally mounted on the other side of the chute 1 facing the set of wheels 15A. The backing wheels are carried by a shaft supported in a window enabling it to move relative to the wheels 15A. The wheel assembly 15A is controlled by a pair of arms 19 hinged about a shaft 19A carried by the top frame 5A. It pivots about the shaft 19A between a position away from the chute 1 making no contact with the set of wheels 15A, which position is referred to as a rest position, and a position in which it enters the chute 1 and bears against the set of wheels 15A, which position is a control position.

The set of shutter fingers 18 is also pivotally mounted facing the inlet chute 1 beneath the set of wheels 15A and the set of backing wheels 15B.

It is advantageously carried by the same pair of arms 19 that control the set of backing wheels 15B so as to be controlled simultaneously therewith. In which case it pivots about the shaft 19A between an obstacle position across the chute 1 which it thereby closes in a position referred to as its "rest" position, and a retracted position away from the chute, which is its control position.

The mail is applied to the inlet 1 when the set of backing wheels 15 and the set of shutter fingers 18 are in their rest positions, such that the mail slides along the inlet tray 1A and inserts itself between the sets of wheels and backing wheels 15A and 15B, coming to rest against the set of shutter fingers 18 which close the chute 1. This set of shutter fingers thus also acts as a jogging abutment for a plurality of documents entered simultaneously into the inlet chute 1. When in its rest position, this set of fingers isolates the inlet 1 from the internal path 10. When in its control position, the set of shutter fingers is withdrawn, thereby opening the chute 1, while the set of backing wheels 15B is pressed against the set of drive wheels 15A, thereby driving the mail along the mail path 10.

In the embodiment shown, the pair of arms 19 is hinged about the shaft 19A carried by the top frame 5A substantially in the middle of its bottom half. This pair of arms extends towards the top of the top frame on either side of the curved chute 17. Its top end serves as an abutment for the shaft of the backing wheels 15B, such that this set of wheels 15B remains at a distance from the set of wheels 15A, or else is caused to press resiliently thereagainst. Beyond this end, it carries the set of shutter fingers which are interposed between the chute 17 and the inlet chute, running from the inside of the bend defined by the chute 17, and separating the chute 17 from the inlet chute, or else they are withdrawn beneath the set of wheels 15A. The pair of arms 19 extends inside the bottom frame beyond the hinge axis for control purposes. Each arm is substantially L-shaped in profile having its hinge axis at an intermediate point along the long arm of the L-shape. This pair of arms 19 actuates the shutter fingers 18 and the backing wheels 15B in such a manner as to delay actuation of the backing wheels 15B relative to actuation of the fingers 18.

The folding module 11 has two pockets 12 and 13 extending along the arms of a V-shape truncated by the set of folding rollers 14. The opening of the V-shape faces the rear walls of the top and bottom frames 15A and 15B. Folding pocket 12 is mounted in the top frame and is referred to as the top pocket. The other pocket 13 is mounted in the bottom frame 5B and is referred to as the bottom pocket.

The set of rollers 14 comprises four rollers associated with the pockets 12 and 13. The rollers have not been given individual reference numerals. A "central" roller of the set has the other three rollers disposed tangentially thereto, said other three rollers being referred to as "peripheral" rollers. Two of the peripheral rollers are substantially diametrically opposite each other about the central roller and together therewith they define the inlet 11A of the folding module which is directly coupled to the path 10, and the outlet 11B of the folding module which is aligned with the path 30 and which is at a short distance from the filling module 31 coupled thereto. The open inlets to the pockets 12 and 13 are inserted between the third peripheral roller and respective ones of the other two peripheral rollers. Two of the rollers, in this case the central roller and that one of the peripheral rollers which defines the inlet 11A of the module together with the central roller are mounted together with the top pocket 12 in the top frame 5A. The other two rollers and the other pockets 13 are mounted in the bottom frame 5B.

In this folding module, each pocket is constituted by a pair of facing plates referenced 12A and 12B for the pocket 12 and 13A and 13B for the pocket 13, and each pocket is closed at its end furthest from its inlet. Each pocket has one of its two plates (referred to as the top plate 12A for the pocket 12 and the bottom plate 13A for the pocket 13) which is fixed inside the frame 5A or 5B bearing the pocket in question. The other plate 12B or 13B in each pocket disposed adjacent to the frame that does not contain a pocket in question is hinged about an end shaft of the pocket disposed at its end furthest from the inlet to the pocket and referenced 12C or 13C. The bottom plate 12B of the pocket 12 and the top plate 13B of the pocket 13 are thus each pivotally mounted about the corresponding shaft. A cable 12D couples the pivoting plate 12B of the top pocket 12 to the rear wall of the bottom frame 5B. Another cable 13D couples the pivoting plate 13B of the bottom pocket 13 to the rear wall of the top frame 5A. These cables thus make it possible to open both pockets simultaneously when the frame 5A is opened relative to the frame 5B.

Advantageously, a finger 1E is associated with the chute 1 and a comparable finger (not shown) is associated with each of the pockets 12 and 13 in order to detect whether or not an item of mail is present thereat. Each of these fingers constitutes an obstacle across the chute or one or other of the pockets, as the case may be, when no mail is present at the finger, with the fingers being retracted merely by the presence of an item of mail. Each of these fingers is coupled to a photoelectric detector (not shown) disposed outside the corresponding chute or pocket, and serving to deliver a corresponding mail-present or mail-absent signal to the control circuit 6.

A motor 10A is coupled to the wheels 15A and 16A and also to one of the rollers 14 of the folding module 11 (which rollers are coupled to one another), for the purpose of transferring mail from the mail path 10 and for the purpose of folding mail. This motor is controlled by the control circuit 6 and is referred to as the mail transfer motor.

The empty envelope inlet magazine 2 or the empty envelope inlet has a sloping bottom and a vertical front wall which are not given reference numerals but which are parts of a shape imparted to the top wall of the top frame 5A, and together they define an empty envelope outlet from the magazine. The bottom is fitted with a set of rollers 2A, with one of these rollers being associated with a backing roller 2B at the outlet from the magazine and forming therewith a separator for empty envelopes extracted from the magazine 2 and delivered to the path 20. These envelopes are extracted from the magazine 2, foot first.

The empty envelope path 20 is defined inside the top frame 5A by a first set of drive wheels 22A and a corresponding set of backing wheels 22B associated with a downstream deflector 23, and by a second set of drive wheels 24A with its set of backing wheels 24B and associated with an upstream deflector constituting the above-mentioned opening means 21. The two deflectors 21 and 23 are on opposite sides of the path 20 and are offset along the path 20, with the mail path 10 intersecting the empty envelope path 20 between the deflectors 21 and 23. Together with the wheels 22A, 22B, and 24A, 24B, they define two oppositely-directed bends on the path 20, thereby curving an envelope so as to encourage its flap to open partially upstream from the deflector 21 and so as to retain its flap and thus open it fully against the edge of said deflector 21. Downstream from the wheels 24A and 24B, and at a small distance therefrom, the path 20 intersects the path 30 at the filling module 31 which thus receives each envelope from the path 20 with the envelope flap open.

A photoelectric detector 25 is mounted on the path 20 close to the filling module 31. In order to make it easier to draw, it has been shown as being between the wheels 24A, 24B and the flap opening deflector 21. However, it is preferably situated immediately downstream from the wheels 24A and 24B. It is coupled to the control circuit 6. It serves to define a defined envelope filling position within the filling module 31, in particular for holding the envelope stationary with its opening facing the outlet 11B from the folding module in order to fill the envelope.

The path 30 is defined by a first set of wheels 31A and associated backing wheels 31B belonging to the filling module 31 and a second set of wheels 34A and associated backing wheels 34B. This path 30 extends between the frames 5A and 5B, with the wheels 31A and 34A being mounted in the top frame 5A and the backing wheels 31B and 34B being mounted in the bottom frame, with the outlet 11B from the folding module 11 being in alignment with the wheels 31A, 31B, and 34A, 34B, and at the opposite end of the path 30 from the wheels 34A and 34B.

On the path 30, the filling module 31 includes the wheels and backing wheels 31A and 31B and envelope body opening fingers 35 mounted upstream from the backing wheels 31B at the end of a support 36. This support extends up from the bottom of the bottom frame where it is hinged about a shaft 36A. It serves to hold the fingers 35 in a retracted position beneath the path 30 upstream from the backing wheels, or to put the fingers 35 into an opening position and hold them there so that they lie on the path 30 between the wheels 31A and the backing wheels 31B.

The backing wheels 31B are themselves retractably mounted beneath the path 30 facing the wheels 31A. They are carried by an arm 37 hinged about a shaft 37A for pivoting them through a relatively short distance so as to bear against the wheels 37A or else to be retracted beneath the path 30. These backing wheels 31B which belong to the filling module 31 are also coupled to the peripheral roller at the outlet 11B from the folding module so as to be driven together with the set of rollers 14. A diagrammatically drawn connection 31C provides this coupling. The coupling 31C passes through a free wheel 31B' enabling the backing wheels 31B to rotate when the envelopes are driven from the mail transfer drive motor 10A.

In a variant of the embodiment shown, the axis 37A about which the arm 37 is hinged is directly constituted by the shaft of the peripheral roller at the outlet 11B of the folding module.

The opening fingers 35 are put into the opening position while the backing wheels 31B are held in their retracted position.

The above-mentioned wheels 24A and backing wheels 24B cooperate with the wheels 31A and backing wheels 31B and the opening fingers 35 of the loading module, keeping the flap of the envelope open while the envelope is being filled, as described below.

On the path 30, the moistening module 32 and the closure module 33 are both mounted one after the other between the wheels 31A with their backing wheels 31B, and the wheels 34A and 34B. These modules are close together with the moistening module 32 being adjacent to the wheels 31A with it backing wheels 31B, with the distance between the wheels 31A and the wheels 34A being slightly less than or close to the height of the envelope bodies.

The moistening module 32 includes an element such as a moistening roller 32A mounted beneath the path 30 and having its periphery which remains slightly beneath the path, together with an associated moistening deflector 32B which is mounted about the path. The moistening roller is partially dipped into water in a supply jar 32D. The jar 32D has two studs 32E on each of its two side walls. It is merely placed in a housing 32F provided in or applied to the bottom frame 5B, with the studs 32E being received in retaining notches formed in the housing 32F.

The moistening deflector is semi-circular in section and is mounted at the end of an arm 38 hinged about a shaft 38A carried by the top frame 5A. The arm 38 extends beyond the shaft 38A inside the bottom frame for actuation purposes. This arm 38 holds the moistening deflector in its rest position in which the deflector faces the moistening roller but lies above the path 30, or else it holds the deflector 32B in its moistening position, when in the moistening position, the deflector interferes with the path 30 and forms an obstacle thereon interposed slightly upstream from the moistening roller 32A. The moistening deflector is put into this moistening position when the flap of the envelope to be moistened arrives at this level along the path 30.

The module 33 for folding the flap and closing the envelope comprises a pair of presser rollers 33A and 33B which are pressed resiliently against each other. The pair of presser rollers is mounted on the terminal portion of a pair of substantially L-shaped arms 39. These arms are hinged at their opposite terminal portions about a shaft 39A carried by the bottom frame 5B. The arms 39 go past opposite sides of the path 30. They are controlled to pivot about the shaft 39A so as to move the pair of presser rollers 33A and 33B between a rest position and a working position. In the rest position, the pair of presser rollers 33A and 33B lies outside the path 30 with the two presser rollers being disposed one above the other and both of them being disposed above the path 30. In the working position, the pair of presser rollers 33A and 33B lies on the path 30, with the two rollers still pressing against each other, with one roller being above the path and the other below.

In the rest position, the pair of presser rollers allow envelopes to travel freely along the path 30 beneath the presser rollers. When actuated to move from the rest position to the working position because an open envelope flap has come level therewith, the rollers serve to fold the flap substantially through 90° relative to the body of the envelope. Once the flap has thus received a first fold, it extends vertically downwards from the path 30 towards the bottom of the bottom frame 5B and on one side of the pair of rollers. Leaving the pair of presser rollers in this working position and reversing the envelope so it passes between the rollers, beginning with the fold line between its flap and the envelope body, serves to close the envelope completely.

When a closed envelope is no longer engaged between one of the sets of wheels and backing wheels of the path 30, it drops freely away from the path 30. The closed envelope outlet 3 in the example shown is provided beneath the path 30 at the front of the machine, thereby making it easier for the user to pick up filled and closed envelopes as delivered by the machine.

It is also advantageous for the backing wheels 34B to be retractably mounted beneath the path 30 facing the wheels 34A. Reference 34 designates the supports carrying the backing wheels 34B. These supports 34 are hinged about shafts 39A of the arms 39 which carry the pair of presser rollers 33A and 33B. They cause the backing wheels 34 to pivot about the shaft 39A so as to put them into a position where they press against the wheels 34A, or else in a retracted position beneath the path 30.

In the machine, a motor 30A is provided for suitably driving the envelopes along the path 20 as along the path 30. This motor is coupled to the drive wheels 22A and 24A of the path 20 and to the drive wheels 31A and 34A of the path 30. The motor 30A is preferably a stepper motor or a D.C. motor. It is controlled in one direction or the other to advance each envelope along the paths 20 and 30 from the outlet from the magazine 2 through the modules fitted on these paths, or else to reverse each envelope along the path 30, in particular. It also serves to stop an envelope in any of the modules along the path 30.

A motor 20A is provided for extracting each envelope from the magazine 2. The motor 20A is coupled to the wheels 2A fitted to the bottom of the magazine and to the envelope outlet from the magazine.

A detector 40 is mounted between the outlet 11B from the folding module and the wheels and backing wheels 31A, 31B of the path 30. It is connected to the control circuit 6 for controlling the loading module 31.

The control circuit 6 controls the machine to perform a control cycle for each item of mail inserted in the mail inlet 1, which item of mail is to be delivered in a franked envelope. In order to run a control cycle, the control circuit 6 is coupled to the motors 10A, 20A, and 30A which are under its control. The control circuit is also coupled to the detector 25 which provides it with a reference signal from which the arrival of an envelope in the loading position in the loading module is detected as are the successive positions or displacements of the envelope along the path 30. It is also coupled to the detector 40 to enable an item of mail to be fully inserted into the corresponding envelope. The control circuit 6 includes a counter triggered by the reference signal given by the detector 25 and serving to count unit displacements or "steps" of the envelope as from the beginning of counting. The counter is coupled to the stepper motor 30A and it counts the steps of this motor without taking account of the direction in which it is rotating. The couplings between the circuits 6 and the motors 10A, 20A, and 30A, and the detectors 15 and 40 are not shown in order to avoid overcrowding FIG. 1.

The control circuit 6 is also coupled to the various hinged arms and supports carrying the backing wheels 15B and the shutter fingers 18, the backing wheels 34B and 31B, the opening fingers 35, the moistening deflector 32B, and the pair of presser rollers 33A and 33B for the purpose of controlling them appropriately during the control cycle. This coupling is obtained via a controlling stepper motor 60 which drives individual cams for actuating these hinged supports and arms. The cams are distributed on two shafts, similar to the single shaft 61 shown, both of which are mounted in the bottom frame and driven by the motor 60. One of the shafts carries the cam for actuating the backing wheels 15B together with the associated shutter fingers 18 for the inlet chute 1, the cam for actuating the opening fingers 35, and the cam for actuating the backing wheel 31B, whereas the other shaft, which is constituted by said shaft 61, carries the cam for actuating the moistening deflector 32B, the cam for actuating the presser rollers 33A and 33B, and the cam for actuating the backing wheels 34B. These cams are not shown in order to avoid overcrowding FIG. 1, but specific angular positions that give rise to particular command effects are described below. The cams have respective cam follower wheels each carried on a corresponding hinged arm or support engaged thereon and designated by the same reference numeral as the arm or support accompanied by the letter C.

The stepper motor 60 for driving the cam shafts is started up on a particular defined value of the count of the control circuit 6. Its speed is chosen as a function of the speed of the motor 30A. Once running, it continues to run in the same direction, synchronously with the stages of a control cycle, regardless of the control signals that may be applied to the motor 30A. It is stopped by detecting a reference position referred to as angular position O on one or other of the two cam shafts, which is a conventional technique and is represented diagrammatically by arrow 61A facing the shaft 61, with a corresponding signal being sent to the control circuit 6.

The machine of the invention is caused to perform one complete control cycle per item of mail to be processed. This cycle is triggered, once an item of mail is ready in the inlet chute 1, by the operator giving an external start control signal which is received by the control circuit 6. Thereafter, four successive phases referred to below as phases 1 to 4 take place, and during each of them appropriate operations are performed one after the other. Phase 1 is the phase during which an open empty envelope is conveyed to the filling module.

When the cycle starts, the control circuit switches on the motor 20A which drives the wheel 2A, and also the motor 30A which drives the wheels 22A, 24A, 31A, and 34A. The control motor 60 is not switched on and the cam shafts such as the shaft 61 are in, and remain in, angular position O. On the paths 20 and 30, the backing wheels 31B and 34B are pressed against wheels 31A and 34B, and the moistening deflector 32B and the pair of presser rollers 33A, 33B are in their rest positions. On path 10, the drive wheels are not driven while the cam shafts are in said position O, the backing wheels 15B are retracted, and the shutter fingers 18 close the chute 1.

By switching on the motors 20A and 30A, an envelope is extracted from the magazine and caused to advance foot first along the path 20 and then along the path 30. To begin with on the path 20 the flap of the envelope is folded down but not sealed against the body of the envelope.

As the envelope advances along the path 20, the detector 25 detects the arrival of the foot of the envelope level with the detector. It generates a signal which is transmitted to the control circuit 6, thereby causing: the motor 20A to be switched off so as to avoid extracting the following envelope; the circuit 6 to start counting the steps of the motor 30A; and the motor 60 for driving the cam shafts to be switched on.

As it continues to advance along the path 20, the envelope is curved in the manner imposed by the path 20. This causes its flap to open a little as it leaves the wheels 22A and the backing wheels 22B, after which the flap is retained by the deflector edge 21 and is opened completely. It then goes past the detector 25 while fully opened and extending flat behind the envelope body.

At a first defined value of the count, indicative of the fold line between the envelope flap and the envelope body reaching the wheels 31A and the backing wheels 31B, the control circuit 6 stops the motor 30A. The envelope is then held stationary with its opening between the wheels 31A and the backing wheels 31B. It is in its filling position within the module 31. The foot of the envelope is engaged between the wheels 34A and 34B, or is nearly engaged therebetween, and its open flap continues to be held between the wheels 24A and the backing wheels 24B of the path 20. At substantially the same instant as the count reaches said first value, the cam shafts are in an angular position which is offset substantially by 90° relative to their position O.

The backing wheels 31B and 34B then take up retracted positions while the opening fingers 35 penetrate into the envelope body.

The moistening deflector and the presser rollers are still in their rest positions, and they remain there.

Phase 2 is the phase during which the mail is transferred and folded.

Phase 2 is started on the above-mentioned first value of the count, optionally followed by a first time delay. The control circuit 6 then switches on the motor 10A. When in the 90° angular position, the cams ensure that the backing wheels 15B are pressing against the wheels 15A and that the shutter fingers 18 are withdrawn, thereby opening the inlet chute 1 to the path 10.

The mail present in the inlet chute 1 is transferred along the path 10 and into the folding module 11 which returns it appropriately folded via outlet 11B. On leaving outlet 11B, the mail is still driven by the rollers of the folding module and it advances towards the open envelope in the filling module 31. The detector 40 detects the passage of the leading edge of the folded mail. It transmits a signal to the control circuit 6, thereby causing the motor 10A to be stopped temporarily.

While the motor is temporarily stopped, the cam shafts continue to be driven and take up an angular position of substantially 135°, in which the backing wheels 31B press again against the wheels 31A. The wheels 31A are still not being driven by the motor 30A which is stopped. However, the backing wheels 31B coupled to the peripheral roller at the outlet 11B of the folding module are driven as soon as the temporary stop of the motor 10A is over. They ensure that the mail is inserted fully into the envelope.

The end of this phase 2 is given after a further optional time delay by the mail disengaging the detector 10. The control circuit 6 then stops the motor 10A. The cams now arrive in angular position 180° retracting the opening fingers 35. The end of phase 2 triggers the beginning of following phase 3.

Phase 3 is the phase during which the filled envelope is closed.

When this phase starts, the motor 30A is restarted in the same direction in order to advance the filled envelope along the path 30. This phase is controlled by the changing state of the step count relative to the motor 30A in the circuit 6.

At a second defined value of this count, representative of the flap reaching the moistening assembly as the envelope advances along the path 30, the motor 30A is stopped for a short predetermined duration. While the motor 30A is stopped, the cams reach angular position 270°, thereby putting the deflector into its control position. When the motor 30A restarts, the envelope continues to advance and its flap is wiped over the moistening roller and is moistened thereby.

At a third defined value of the count, indicative of the flap coming level with the pair of presser rollers 33A and 33B as the envelope continues to advance along the path 30, the control circuit 6 stops the motor 30A again for a further short period. During this stop, the cams reach an angular position substantially equal to 315° and cause the pair of presser rollers 33A and 33B to move from their rest position to their control position, thereby folding the flap ahead of them through 90° relative to the envelope body, while the moistening deflector is simultaneously returned to its rest position. After this stop, the motor 30A is again switched on but this time in reverse, with its reverse steps continuing to cause the step count to increase. The envelope reverses along the path 30, flap first, thereby folding the flap down completely against the envelope body between the presser rollers 33A and 33B and thus sealing the flap against the envelope body.

At a fourth defined value of the count, indicative of the entire folded down flap having passed between the presser rollers 33A and 33B, the control circuit 6 switches the motor 30A back to running forwards. The flap passes back between the presser rollers 33A and 33B and the envelope advances along the path 30 between the wheels 34A and the backing wheels 34B. When the envelope escapes from these wheels and backing wheels 34A, 34B, it leaves the path 30 and falls, now closed, to the outlet 3 from the machine.

During this advance, the cams return to reference position O which is detected, causing the control motor 60 to stop so as to keep the cams in this position. The cams return the pair of presser rollers 33A and 33B to their rest position.

At a fifth value of the count, representative of the envelope having left the wheels 34A and the backing wheels 34B, the motor 30A is finally stopped and the cycle has terminated.

Figure 2:
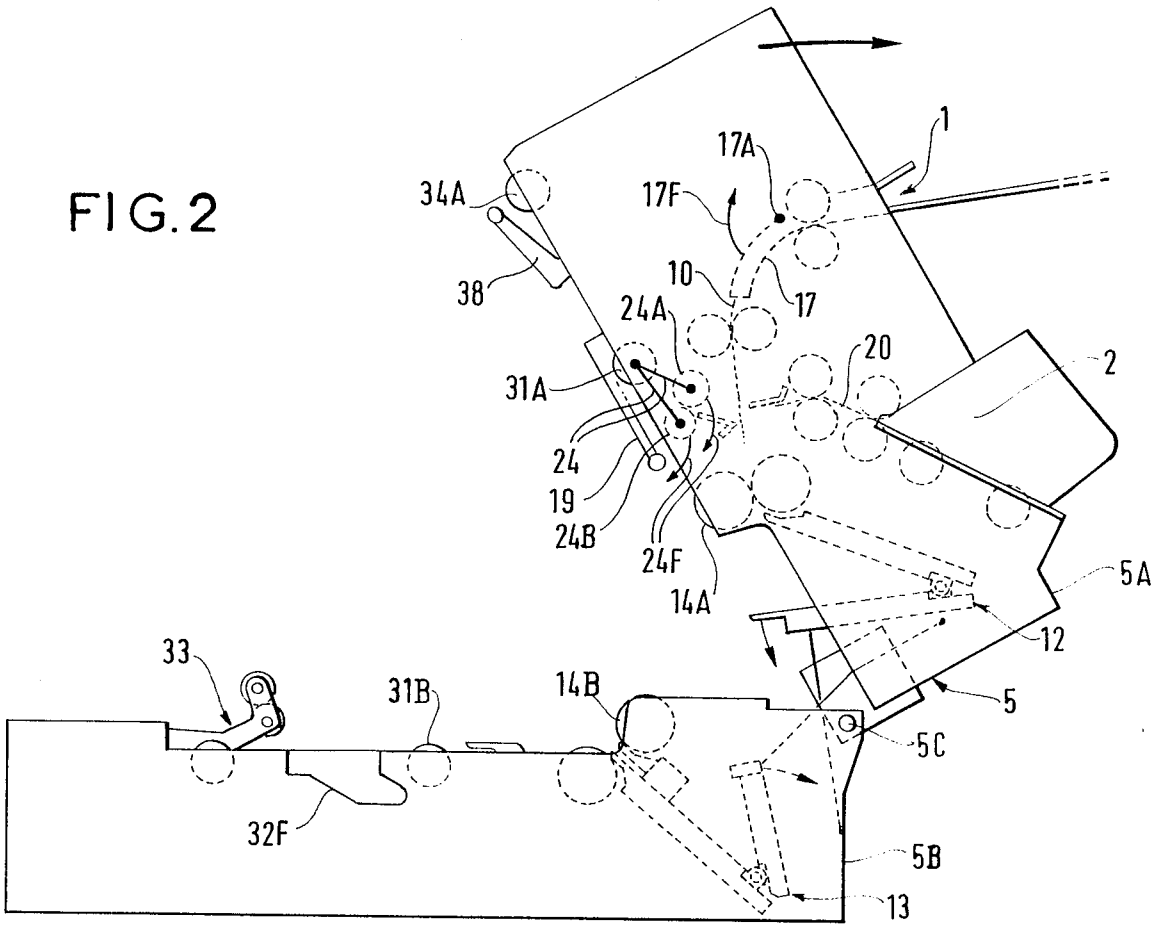
FIG. 2 is a diagram showing said machine when opened.

FIG. 2 shows the FIG. 1 machine more diagrammatically and on a smaller scale, but with the top frame 5A open on the bottom frame 5B. This opening operation about the shaft 5C serves to simultaneously to open the above-mentioned path 30 along its entire length with its wheels 31A and 34A being lifted by the top chassis on which they are mounted, and disassembles the folding module 11, the filling module, and the moistening module. On the path 30, there remain solely the folding module and the module 33 for closing the envelope flap, both of which are in their rest positions.

It is thus easy to clear any jam which may occur on the path 30. In addition, the housing 32F for the jar of water for the moistening module is shown without its jar which is easily removed when the path 30 is open, and the moistening deflector is taken out of the way by its arm 38 with the top frame.

This same operation of opening the machine also fully opens the folding module at the end of the path 10 and disassembles the set of folding rollers carried in part (14A) on the top frame and in part (14B) on the bottom frame, with the folding pockets 12 and 13 being simultaneously and automatically opened. Any jam which may have occurred in the folding module 11 is thus easily cleared.

Access to the path 10 or to the path 20 is also easy via the open bottom face of the top frame. In addition, the bottom deflector of the guide chute 17 on the path 10 may be dismountable. It is shown merely as being openable by pivoting in the direction of arrow 17F about an end shaft 17A carried in the top frame. Similarly, for the path 20, the wheels 24A and the backing wheels 24B may be mounted on supports 24 which are hinged to the same shaft as the wheels 31A in order to open the path 20 by pivoting one or other or both sets of wheels 24A and 24B, as represented by individual arrows 24F.

The present invention has been described with reference to an embodiment shown in the drawings. Naturally detail modifications may be made thereto and certain means may be replaced by other, equivalent means without thereby going beyond the scope of the invention. In particular, particular positions of the envelope along the path 30 may be detected by using detectors analogous to the detectors 25 and 40. Signals from such detectors can be used for controlling the forwards drive, the stopping, and the backwards drive of the motor 30A. Such signals may also be used for controlling electromagnets for actuating the various hinged arms and supports.

We claim:

1. An integrated office machine for folding items of mail and putting them into envelopes, the machine comprising a first path coupled to a mail inlet and feeding a folder having two folding pockets associated with a set of folding rollers, a second path coupled to an empty envelope inlet and feeding a filling station itself coupled to the folder to receive folded mail, and a third path fitted with means for closing the envelopes and coupled to the filling station and to an outlet for filled and closed envelopes, wherein the machine is mounted in a quasi-closed machine frame constituted by a top frame hinged to a bottom frame to open about a hinge axis at the rear end of the bottom frame, and:

said first and second paths are defined inside the top frame, and said third path is defined between said top and bottom frames, with said second path leading to said third path;

said filling station constitutes a functional filling module on said third path and at the opposite end to the envelope inlet on the second path, a portion of said functional module being mounted in the top frame and the remainder being mounted in the bottom frame; and said folder constitutes a folding functional module between said first and third paths, with a portion of the set of folding rollers and one of the folding pockets being mounted in the top frame and with the remaining portion of the set of folding rollers and the other folding pocket being mounted in the bottom frame, the folding module having an inlet at the opposite end to the mail inlet on the first path and an outlet facing said filling module to which it is directly coupled.

2. An integrated office machine according to claim 1, wherein said first and second paths are defined inside said top frame, with the mail inlet being closer to the front of the machine than the envelope inlet, both on the top frame, and with said first and second paths intersecting each other in the top frame.

3. An integrated office machine according to claim 2, wherein said second path includes at least a first set of wheels and backing wheels coupling it to the envelope inlet, a second set of wheels and backing wheels coupling it to the filling module, and between said sets of wheels and backing wheels, a first deflector for guidance purposes and a second deflector for guiding and for opening the flap of an envelope, said deflectors forming two opposite bends on said second path giving it a substantially S-shaped trajectory extending substantially from a top portion at the rear of the top frame to a bottom portion in the middle of the top frame.

4. An integrated office machine according to claim 3, wherein said envelope inlet is fitted with an empty envelope magazine having a motor for extracting envelopes from the magazine, and having envelope separator means at its outlet.

5. An integrated office machine according to claim 2, wherein said first path includes at least one third set of wheels and backing wheels coupling it to the mail inlet, a fourth set of wheels and backing wheels coupling it to the inlet of the folding module, and an intermediate guide chute imparting a curved trajectory thereto extending substantially from a top front portion of the top frame to a bottom rear portion of said top frame.

6. An integrated office machine according to claim 5, wherein said mail inlet is fitted with a flap on the top frame constituted by a sloping inlet tray having its bottom end in front and partially inserted inside the top frame to define an inlet chute therein.

7. An integrated office machine according to claim 6, wherein said inlet tray has lateral windows above the top frame enabling multi-sheet items of mail inserted in said mail inlet chute to be appropriately adjusted in position by hand.

8. An integrated office machine according to claim 6, wherein said third set of wheels and backing wheels is mounted facing the inlet chute and is associated with shutter fingers retractably mounted to couple said inlet chute and said first path or else to isolate them and constitute a jogging abutment for items of mail.

9. An integrated office machine according to claim 8, wherein said third set of wheels and backing wheels has its backing wheels retractably mounted on said inlet chute and coupled to said shutter fingers in order to be actuated simultaneously therewith, so as to press against the associated wheels when the shutter fingers are retracted to facilitate insertion of mail into the inlet chute when said shutter fingers isolate the inlet chute from said path.

10. An integrated office machine according to claim 9, wherein said shutter fingers are carried by a first terminal portion of a pair of arms hinged on a shaft carried by the top frame and controlled at the opposite terminal portion which extends into the bottom frame, and wherein said first terminal portion of the pair of arms forms an actuating abutment for said retractable backing wheels facing the third set of wheels, said pair of arms coming uncoupled from its control means in the bottom frame when the top frame is opened.

11. An integrated office machine according to claim 9, wherein said guide chute is hinged to open about a terminal shaft on said chute and carried by the top frame to enable said first path to be opened when the top frame is open.

12. An integrated office machine according to claim 3, wherein said third path includes a fifth set of wheels and backing wheels and a sixth set of wheels and backing wheels situated on the same side of and in alignment with the outlet from the folding module, and having said closure means mounted therebetween, said fifth and sixth sets of wheels being coupled to an envelope drive motor.

13. An integrated office machine according to claim 12, wherein said second set of wheels and backing wheels is hinged on the shaft of the wheels in the fifth set, in order to open said second path when the top frame is open.

14. An integrated office machine according to claim 12, and in which the closure means are associated with a flap moistening assembly, wherein:

the moistening assembly comprises a moistening element and an associated pivoting moistening deflector mounted on either side of said third path, between the fifth and sixth sets of wheels and backing wheels;

said closure means being mounted between the sixth set of wheels and backing wheels and the moistening assembly, and comprising a pair of presser rollers mounted to pivot between a rest position of the third path and a working position on the third path, in which said presser rollers lie on either side of said third path; and said envelope drive motor coupled to the wheels of said fifth and sixth sets of wheels and backing wheels is driven in one direction or the other and is controlled together with said moistening deflector and said pair of presser rollers by a control circuit as a function of the position of each envelope along said third path.

15. An integrated office machine according to claim 14, wherein said moistening deflector is carried by an arm hinged about a shaft in the top frame and extending beyond said shaft into the bottom frame for control purposes, said are becoming decoupled from its control means when the top chassis is open on the bottom chassis.

16. An integrated office machine according to claim 14, wherein said moistening element is mounted in a water supply jar, and wherein said jar carries means enabling it to be directly positioned and retained in a retaining housing provided in the bottom frame, said jar being removable from its housing when said top frame is open.

17. An integrated office machine according to claim 12, wherein said envelope drive motor is a stepper motor.

18. An integrated office machine according to claim 12, wherein said envelope drive motor is a D.C. motor.

19. An integrated office machine according to claim 12, wherein said filling module comprises:

said fifth set of wheels and backing wheels with the backing wheels being retractably mounted beneath said third path and coupled to the rollers of the folding module in order to be driven by a mail-drive motor;

an envelope detector mounted on the second path, and a mail detector mounted between the outlet from the folding module and the filling module;

said envelope and mail detectors both being coupled to said control circuit in order to control said filling module by stopping said envelope motor when the envelope driven along said second and third paths arrives in a defined filling position between said fifth set of wheels and backing wheels, then by putting the backing wheels of the filling module in the retracted position, then by raising them when the mail driven along said first path and through the folding module arrives at the mail detector, and finally by returning the backing wheels of the filling module into the retracted positon when the mail leaves the mail detector.

20. An integrated office machine according to claim 19, wherein said backing wheels of the filling module are coupled to one of the rollers of the folding module in order to be driven thereby while mail is being transferred along said first path and through the folding module.

21. An integrated office machine according to claim 20, wherein the coupling between the backing wheels of the filling module and one of the rollers in the folding module is provided via a freewheel mechanism.

* * * * *